US012203335B2

(12) United States Patent
Fripp et al.

(10) Patent No.: US 12,203,335 B2
(45) Date of Patent: Jan. 21, 2025

(54) TEMPERATURE COMPENSATOR FOR IMPROVED SEALING

(71) Applicant: Halliburton Energy Services, Inc., Houston, TX (US)

(72) Inventors: Michael Linley Fripp, Singapore (SG); Xiaoguang Allan Zhong, Singapore (SG); Shobeir P. Gar, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 27 days.

(21) Appl. No.: 18/083,269

(22) Filed: Dec. 16, 2022

(65) Prior Publication Data

US 2024/0200422 A1 Jun. 20, 2024

(51) Int. Cl.
*E21B 33/128* (2006.01)
*E21B 23/06* (2006.01)

(52) U.S. Cl.
CPC ..... *E21B 33/128* (2013.01); *E21B 23/06* (2013.01)

(58) Field of Classification Search
CPC ..... E21B 33/128; E21B 23/06; F16J 15/04; F16J 15/102
See application file for complete search history.

(56) References Cited

U.S. PATENT DOCUMENTS 5,294,133 A * 3/1994 Dutta ..... F16J 15/32 277/910
6,305,477 B1 10/2001 Carisella et al.
7,347,242 B2 3/2008 Agostini et al.
7,557,492 B2 7/2009 Fripp et al.
10,519,740 B2 * 12/2019 Pray ..... E21B 33/1293
10,975,658 B2 4/2021 Zhang et al.
2010/0294483 A1 11/2010 Turley et al.
2010/0313987 A1 12/2010 Salama et al.
2012/0125640 A1 5/2012 Sevre
2014/0284046 A1 9/2014 Bramwell
2015/0204158 A1 * 7/2015 Frisby ..... E21B 33/1208 166/387
2015/0218903 A1 * 8/2015 Sellers, Jr. ..... E21B 33/1291 166/380
2016/0068728 A1 * 3/2016 Akulichev ..... C09K 3/1025 524/424
2017/0191565 A1 * 7/2017 Cheng ..... E21B 33/00
2017/0247983 A1 8/2017 Funkhouser

OTHER PUBLICATIONS

International Search Report and Written Opinion mailed Sep. 6, 2023 for PCT/US2022/053845.

* cited by examiner

*Primary Examiner* — Nicole Coy
*Assistant Examiner* — Nicholas D Wlodarski
(74) *Attorney, Agent, or Firm* — The Hilton Firm PLLC

(57) ABSTRACT

Methods and apparatus for performing a wellbore operation. A thermal compensator is introduced into a wellbore having a temperature. The thermal compensator comprises an outer layer comprising a first material, an inner layer comprising a second material, and a core disposed between the inner layer and the outer layer; wherein the core comprises a third material. The third material has a higher coefficient of thermal expansion than the first material and the second material. The core contracts when the wellbore temperature is decreasing and the contraction of the core moves the outer layer such that it applies a force to a structure adjacent to the outer layer.

20 Claims, 4 Drawing Sheets

TEMPERATURE COMPENSATOR FOR IMPROVED SEALING

TECHNICAL FIELD

The present disclosure relates generally to using a temperature compensator for sealing operations, and more particularly, to the use of a temperature compensator to maintain seal integrity in high-temperature environments that are subjected to periods of cooling.

BACKGROUND

Sealing elements may be used to form seals in high temperature environments such as a wellbore. In some wellbore operations, wellbore cooling may occur naturally or may be induced via temperature cycling or other operation. Some sealing elements may possess a coefficient of thermal expansion greater than that of an adjacent wellbore tool (e.g., a steel mandrel containing the sealing element or the surrounding steel wellbore tubing). This difference in the coefficient of thermal expansion may result in a greater contraction of the sealing element than the adjacent wellbore tool during periods of cooling. In such cases, the sealing element may contract more than the adjacent wellbore tool.

Temperature compensation is the process of adjusting a system's performance to compensate for the effects caused by changing temperatures. The present invention provides improved apparatus and methods for sealing in environments subjected to fluctuations in temperature.

BRIEF DESCRIPTION OF THE DRAWINGS

Illustrative examples of the present disclosure are described in detail below with reference to the attached drawing figures, which are incorporated by reference herein, and wherein.

Figure 1A:
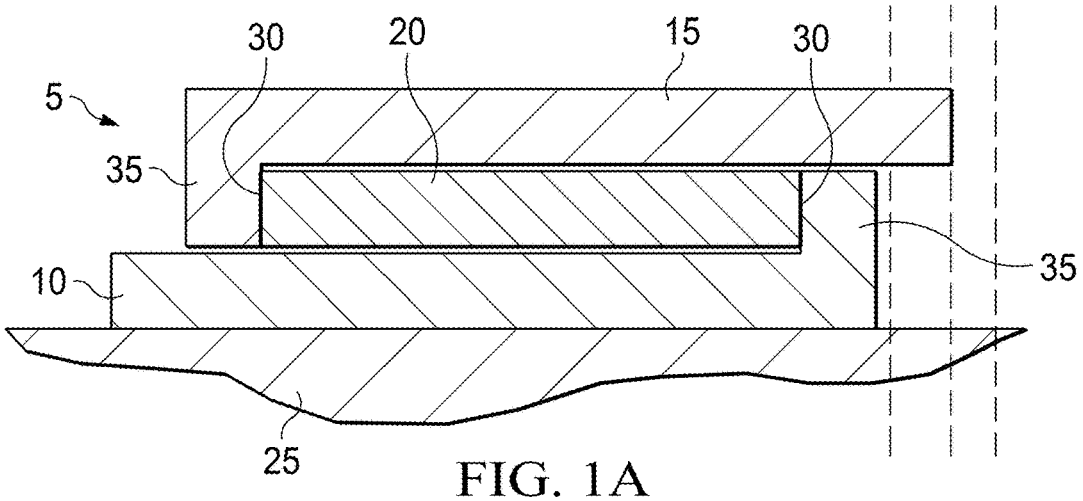
FIG. 1A is a schematic illustrating an example thermal compensator in its neutral state in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to using a temperature compensator for sealing operations, and more particularly, to the use of a temperature compensator to maintain seal integrity in high-temperature environments that are subjected to periods of cooling.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The examples described herein relate to the use of a temperature compensator to maintain seal integrity in wellbore environments subjected to temperature fluctuations such as periods of cooling or thermal cycling. The temperature compensator is constructed to possess a negative coefficient of thermal expansion (hereafter "CTE"). The temperature compensator is formed from the combination of a low CTE material and a high CTE material. One advantage of the temperature compensator is that the temperature compensator may expand upon the cooling of the surrounding environment. An additional advantage of the temperature compensator is that upon cooling, the resulting expansion of the temperature compensator may be used to compensate for the contraction of an adjacent sealing element, such as an elastomeric sealing element to some degree. One other advantage is that the temperature compensator may be disposed on the same steel mandrel as the sealing element. In some examples, the combination of the positive CTE sealing element and the negative CTE temperature compensator may result in a sealing element-compensator system that approximates the CTE of an adjacent steel mandrel, wellbore tubing, or other wellbore tool or tool component thereby providing a degree of expansion/contraction for the sealing element-compensator system that may be approximately synchronized with the adjacent steel mandrel, wellbore tubing, or other wellbore tool or tool component.

The thermal compensator comprises the combination of a low CTE material and a high CTE material. The combination and arrangement of these components produces a negative CTE apparatus having an effective negative CTE allowing the thermal compensator to expand upon cooling. The degree of expansion and contraction as well as the temperature ranges in which these effects occur is a function of the low CTE material selected, the high CTE material selected, and their relative configuration within the thermal compensator.

The thermal compensator expands in a cooling environment to apply a force to an adjacent structure (e.g., a sealing element). A cooling environment is any environment, such as a wellbore, in which the temperature is decreasing. The rate of decrease may be a factor, in some examples, in the rate of expansion of the thermal compensator. An environment cooling at a faster rate may induce a faster rate of expansion for the thermal compensator. An environment cooling at a slower rate may induce a slower rate of expansion for the thermal compensator. Regardless, the thermal compensator expands in any environment that is cooling. The force applied to the adjacent structure may be maintained so long as the environmental temperature continues to cool, or so long as the environmental temperature is maintained at the temperature at which the thermal compensator expanded. Should the environment begin to warm, the thermal compensator may begin to contract. If contraction continues, the thermal compensator may contract to a point where pressure is no longer applied to the adjacent structure.

FIG. 1A is a schematic illustrating an example thermal compensator, generally 5. The thermal compensator 5 comprises a housing divided into two component parts that sandwich and at least partially surround a core 20. These two parts are referred to as an inner layer 10 and an outer layer 15. The inner layer 10 is the housing component closest to the wellbore tool (in this example the wellbore is the mandrel 25) that the thermal compensator 5 is disposed upon. The outer layer 15 is the housing component farthest away from the mandrel 25 but is closest to an adjacent tubing (not illustrated) that would surround the temperature compensator 5. The inner layer 10 and the outer layer 15 comprise the low CTE materials. The inner layer 10 is fixed to the mandrel 25 and does not translate along the exterior of the mandrel 25 but will expand/contract in size due to fluctuating temperatures. The inner layer 10 may be bolted, welded, threaded, screwed, adhered, swaged, or otherwise fixed to the mandrel 25 in any manner as would be readily apparent to one of ordinary skill in the art. In some examples, the inner layer 10 and the outer layer 15 comprise the same low CTE material. In other examples, the inner layer 10 and the outer layer 15 may comprise different low CTE materials. The core 20 comprises the high CTE material. It is to be understood that the exact CTE for the high and low CTE materials is not limited to any specific value or range. As used herein, the "high CTE material" refers to a material having a CTE higher than the low CTE material. As used herein, the "low CTE material" refers to a material having a CTE lower than the high CTE material. In some examples, the high CTE material and the low CTE material have a linear coefficient of thermal expansion that differs by at least $5\times10^{-6}$ per ° C. and preferably greater than $20\times10^{-6}$ per ° C. For example, carbon steel has a CTE of $11\times10^{-6}$ per ° C. in a temperature range of 20° C. to 200° C. Aluminum has a CTE of $23\times10^{-6}$/° C. in a temperature range of 20° C. to 200° C. If carbon steel and aluminum were used in combination in the thermal compensator 5, carbon steel would be the low CTE material and would form one of or both of the inner layer 10 and the outer layer 15. Aluminum would be the high CTE material and would form the core 20. The inner layer 10 is coupled to the core 20 with a physical connection or hydrostatic pressure. The outer layer 15 is also coupled to the core 20 with a physical connection or hydrostatic pressure. Connection points 30 are illustrated occurring on the ends of the core 20. The left-most end of core 20 couples the core 20 to the inner portion of the lip 35 of the outer layer 15. The right-most end of core 20 couples the core 20 to the inner portion of the lip 35 of the inner layer 10. This arrangement may be reversed in alternative examples. The coupling of the core 20 to the lips 35 of the inner layer 10 and the outer layer 15 allow the core 20 to function somewhat analogously to a piston, except that the core 20 moves the outer layer 15 by the contraction and expansion of the core 20 itself. Additionally, the expansion and contraction of the outer layer 15 and the inner layer 10 also result in the movement of the outer layer 15 relative to the mandrel 25.

The optional connection points 30 are the locations of the potential coupling mechanisms for the core 20 and the inner layer 10 or outer layer 15. The coupling mechanism may be a threaded, bolted, riveted, brazed, press fitted, adhered (with adhesive), or welded connection to fix the ends of the core 20 to the inner portions of the lip 35 of the outer layer 15 and the inner layer 10. In some examples which are discussed in greater detail below, the coupling mechanism may be the proximate hydrostatic pressure instead of a physical mechanism at the connection points 30. In some examples, the core 20 may be a high CTE fluid that is sealed within the outer layer 15 and the inner layer 10 via O-rings or other types of sealing elements sufficient for forming a fluid tight seal. In this specific example, the hydrostatic pressure holds the inner layer 10 and outer layer 15 to the core 20. If the outer layer 15 and/or the inner layer 10 were to separate from the core 20, an air space would be created in the sealed area around the core 20 and the surrounding hydrostatic pressure would push the components together to close that air space. As a result, the outer layer 15 and the inner layer 10 would stay coupled to the core 20 so long as hydrostatic pressure is present.

Figure 1B:
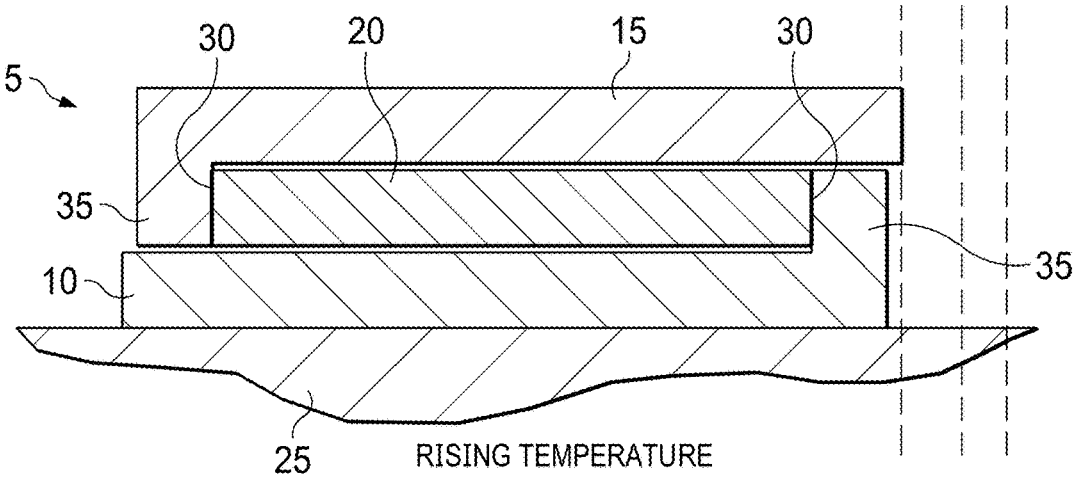
FIG. 1B is a schematic illustrating the example thermal compensator of FIG. 1A in its contracted state in accordance with one or more examples described herein.

FIG. 1B illustrates the thermal compensator 5 when the surrounding temperature is rising. As the temperature rises, the higher CTE core 20 expands more than the lower CTE inner layer 10 and outer layer 15. As the core 20 expansion is greater than that of the expansion of the outer layer 15, the core 20 pulls the outer layer 15 in a direction to retract it relative to the boundary lines illustrated to the right of the thermal compensator 5. The inner layer 10 remains fixed on the mandrel 25. The boundary lines represent the relative location of adjacent wellbore tools such as sealing elements upon which the expansion of the thermal compensator could act. In this example, the temperature compensator 5 is applying a reduced pressure to the adjacent wellbore tool represented by the boundary lines.

Figure 1C:
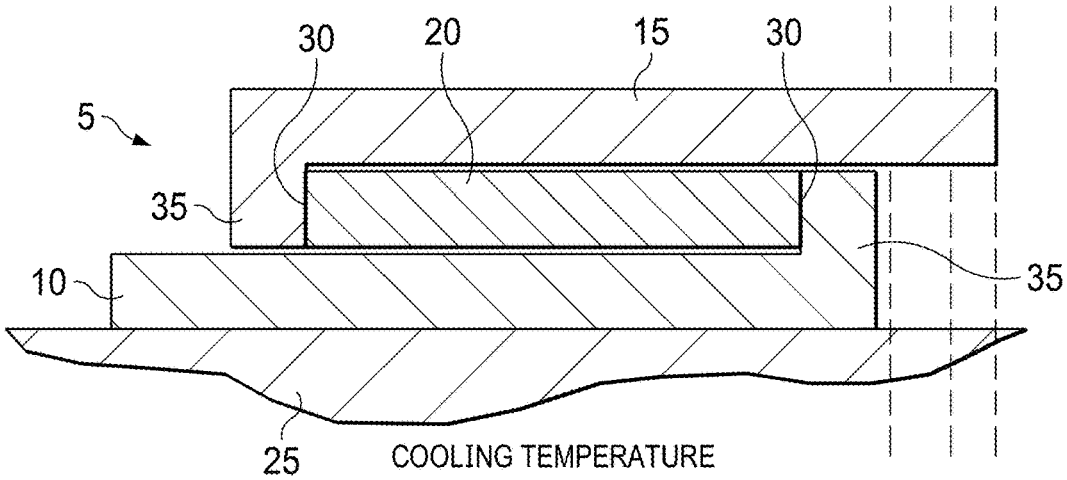
FIG. 1C is a schematic illustrating the example thermal compensator of FIG. 1A in its expanded state in accordance with one or more examples described herein.

FIG. 1C illustrates the thermal compensator 5 when the surrounding temperature is cooling. As the temperature decreases, the higher CTE core 20 contracts more than the lower CTE inner layer 10 and outer layer 15. As the core 20 contraction is greater than that of the contraction of the outer layer 15, the core 20 pulls the outer layer 15 in a direction to expand it relative to the boundary lines illustrated to the right of the thermal compensator 5. The inner layer 10 remains fixed on the mandrel 25. The boundary lines represent the relative location of adjacent wellbore tools such as sealing elements upon which the expansion of the thermal compensator could act. This expansion of the outer layer 15 provides the effect of a net negative CTE thermal compensator 5 that expands as the temperature cools. This expansion during cooling occurs despite the thermal compensator 5 possessing a positive and large CTE material for the core 20. In this example, the temperature compensator 5 applies pressure to the adjacent wellbore tool represented by the boundary lines. This pressure may assist the adjacent wellbore tool in maintaining its functionality during this period of cooling, for example, this pressure applied to an adjacent sealing element may force the sealing element to maintain a sufficiently expanded state thereby improving seal integrity.

Figure 2A:
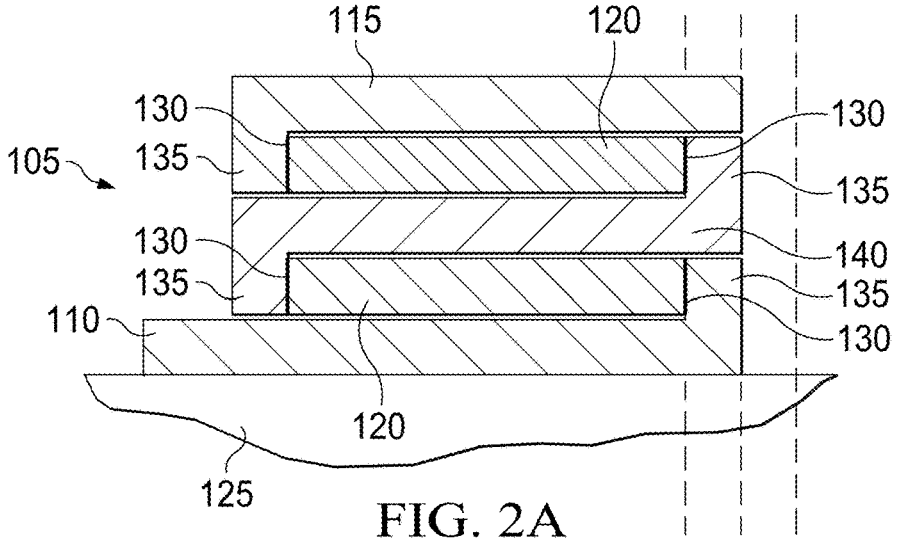
FIG. 2A is a schematic illustrating another example thermal compensator in its neutral state in accordance with one or more examples described herein.

FIG. 2A is a schematic illustrating another example thermal compensator, generally 105, that stacks multiple layers circumferentially. The thermal compensator 105 comprises two cores 120 of high CTE material in a series separated by a middle layer 140. This arrangement allows thermal compensator 105 to achieve a longer displacement distance than the single core thermal compensator 5 of FIGS. 1A-1C. Beneficially, this longer displacement distance is achieved while maintaining the same length of the thermal compensator 5 of FIGS. 1A-1C while in the neutral state. The thermal compensator 105 comprises a housing divided into three component parts that sandwich and at least partially surround the two cores 120. These three parts are referred to as an inner layer 110, an outer layer 115, and a middle layer 140. The inner layer 110 is the housing component closest to the wellbore tool (in this example the wellbore tool is the mandrel 125) that the thermal compensator 105 is disposed upon. The outer layer 115 is the housing component farthest away from the mandrel 125 but is closest to an adjacent tubing (not illustrated) that would surround the temperature compensator 105. The middle layer 140 is disposed between the inner layer 110 and the outer layer 115. The inner layer 110, the middle layer 140, and the outer layer 115 comprise the low CTE materials. The inner layer 110 is fixed to the mandrel 125 and does not translate along the exterior of the mandrel 125 but will expand/contract in size due to fluctuating temperatures. The inner layer 110 may be bolted, welded, threaded, screwed, adhered, swaged, or otherwise fixed to the mandrel 125 in any manner as would be readily apparent to one of ordinary skill in the art. In some examples, the inner layer 110, the middle layer 140, and the outer layer 115 comprise the same low CTE material. In other examples, the inner layer 110, the middle layer 140, and the outer layer 115 may comprise different low CTE materials. The cores 120 comprise the high CTE material. A first core 120 is disposed between the inner layer 110 and the middle layer 140. A second core 120 is disposed between the outer layer 115 and the middle layer 140. The cores 120 may comprise the same or different high CTE materials. It is to be understood that the exact CTE for the high and low CTE materials is not limited to any specific value or range. The inner layer 110 is coupled to one of the cores 120 with a physical connection or hydrostatic pressure. The outer layer 115 is coupled to the other core 120 with a physical connection or hydrostatic pressure. The middle layer 140 is coupled to both cores 120 with a physical connection or hydrostatic pressure. Connection points 130 are illustrated occurring on the ends of the cores 120. The right-most end of the core 120 coupled to the inner layer 110 is coupled to the inner portion of the lip 35 of the inner layer 110. The left-most end of the core 120 coupled to the inner layer 110 is coupled to the inner portion of the lip 35 of the middle layer 140. The right-most end of the core 120 coupled to the outer layer 115 is coupled to the inner portion of the lip 35 of the middle layer 140. The left-most end of the core 120 coupled to the outer layer 115 is coupled to the inner portion of the lip 35 of the outer layer 115. The coupling of the cores 120 to the lips 135 of the inner layer 110, the middle layer 140, and the outer layer 115 allow the cores 120 to function somewhat analogously to a piston, except that the cores 120 move the middle layer 140 and the outer layer 115 by the contraction and expansion of the cores 120 themselves. Additionally, the expansion and contraction of the outer layer 115, the middle layer 140, and the inner layer 110 also result in the movement of the middle layer 140 and outer layer 15 relative to the mandrel 125.

The optional connection points 130 are the locations of the potential coupling mechanisms for the cores 120 and the inner layer 110, the middle layer 140, or the outer layer 115. The coupling mechanism may be a threaded, bolted, riveted, brazed, press fitted, adhered (with adhesive), or welded connection to fix the ends of the cores 120 to the inner portions of the lips 135 of the outer layer 115, the middle layer 140, and the inner layer 110. In some examples which are discussed in greater detail below, the coupling mechanism may be hydrostatic pressure instead of a physical mechanism at the connection points 130. In some examples, the cores 120 may be a high CTE fluid that is sealed within the outer layer 115, the middle layer 140, and the inner layer 110 via O-rings or other types of sealing elements sufficient for forming a fluid tight seal. In this specific example, the hydrostatic pressure holds the inner layer 110, the middle layer 140, and outer layer 115 to their respective cores 120. If the outer layer 115, the middle layer 140, and/or the inner layer 110 try to separate from the cores 120, an air space is created in the sealed areas around the cores 120 and the surrounding hydrostatic pressure would push the components together to close that air space. As a result, the outer layer 115, the middle layer 140, and the inner layer 110 would stay coupled to their respective cores 120 as long as hydrostatic pressure is present.

Figure 2B:
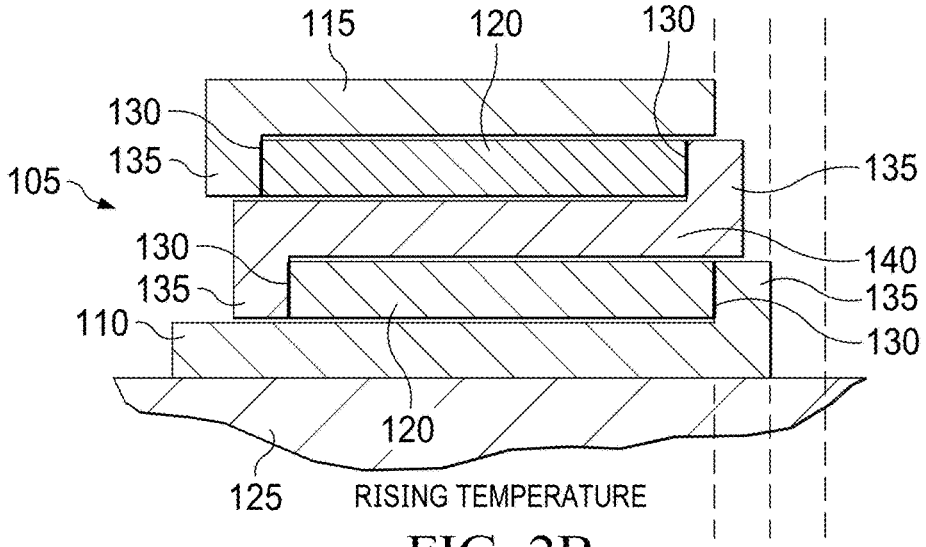
FIG. 2B is a schematic illustrating the example thermal compensator of FIG. 2A in its contracted state in accordance with one or more examples described herein.

FIG. 2B illustrates the thermal compensator 105 when the surrounding temperature is rising. As the temperature rises, the higher CTE cores 120 expand more than the lower CTE inner layer 110, the middle layer 140, and the outer layer 15.

As the cores' 120 expansion is greater than that of the expansion of the middle layer 140 and the outer layer 115, the cores pull the middle layer 140 and the outer layer 115 to retract them relative to the boundary lines illustrated to the right of the thermal compensator 105. The inner layer 110 remains fixed on the mandrel 125. The boundary lines represent the relative location of adjacent wellbore tools such as sealing elements. In this example, the temperature compensator 105 is applying a reduced pressure to the adjacent wellbore tool represented by the boundary lines.

Figure 2C:
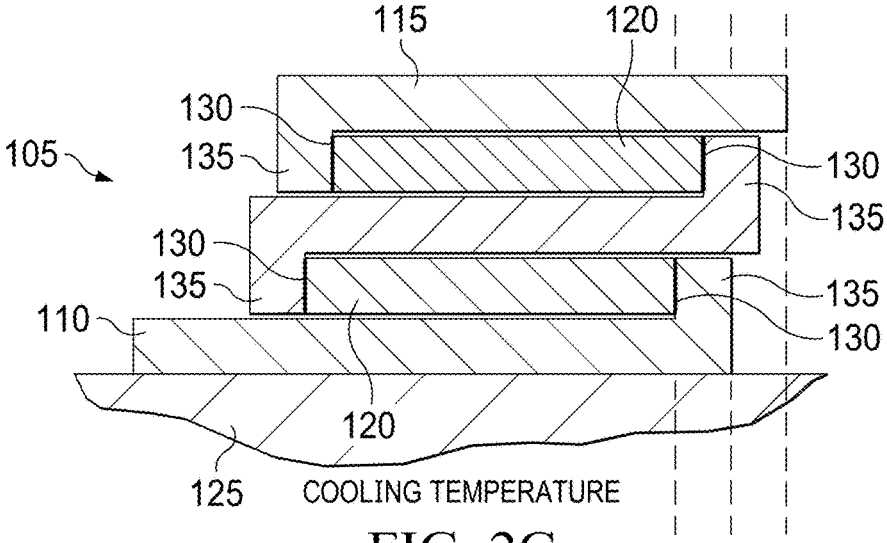
FIG. 2C is a schematic illustrating the example thermal compensator of FIG. 2A in its expanded state in accordance with one or more examples described herein.

FIG. 2C illustrates the thermal compensator 105 when the surrounding temperature is cooling. As the temperature decreases, the higher CTE cores 120 contract more than the lower CTE inner layer 110, the middle layer 140, and the outer layer 115. As the cores' 120 contraction is greater than that of the contraction of the middle layer 140 and the outer layer 115, the cores pull the middle layer 140 and the outer layer 115 to expand them relative to the boundary lines illustrated to the right of the thermal compensator 105. The inner layer 110 remains fixed on the mandrel 125. The boundary lines represent the relative location of adjacent wellbore tools such as sealing elements. This expansion of the middle layer 140 and the outer layer 115 provides the effect of a net negative CTE thermal compensator 105 that expands as the temperature cools. This expansion during cooling occurs despite the thermal compensator 105 possessing a positive and large CTE material for the cores 120. In this example, the temperature compensator 105 applies pressure to the adjacent wellbore tool represented by the boundary lines. This pressure may assist the adjacent wellbore tool in maintaining its functionality during this period of cooling, for example, this pressure applied to an adjacent sealing element may force the sealing element to maintain a sufficiently expanded state thereby improving seal integrity. Moreover, the thermal compensator 105 may be able to achieve twice the stroke of a single core 120 thermal compensator of the same length.

Figure 3:
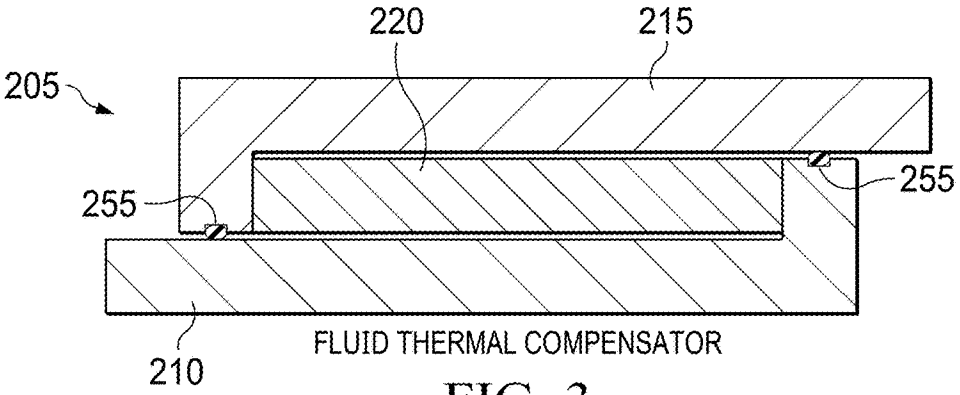
FIG. 3 is a schematic illustrating another example thermal compensator in its neutral state in accordance with one or more examples described herein.

FIG. 3 is a schematic of a thermal compensator 205. The thermal compensator 205 functions analogously to the thermal compensator 5 of FIGS. 1A-1C. As the temperature cools, the thermal compensator 205 expands in length to apply pressure to an adjacent wellbore tool or component. Additionally, the thermal compensator 205 comprises O-ring seals 255. O-ring seals 255 seal core 220 within the inner layer 210 with the outer layer 215. This arrangement allows for the optional use of a fluid core 220. The fluid core 220 may be any fluid (e.g., silicone oil) having a CTE higher than that of the low CTE inner layer 210 and outer layer 215. For example, the core 220 may be silicone oil and the inner layer 210 and the outer layer 215 may comprise steel. The thermal compensator 205 could also contain a fill port (not illustrated) wherever it is convenient. In some alternative examples, a high CTE material having poor compressive strength such as an elastomeric material or a polymer such as polytetrafluoroethylene could be used in place of the fluid for the core 220.

Figure 4:
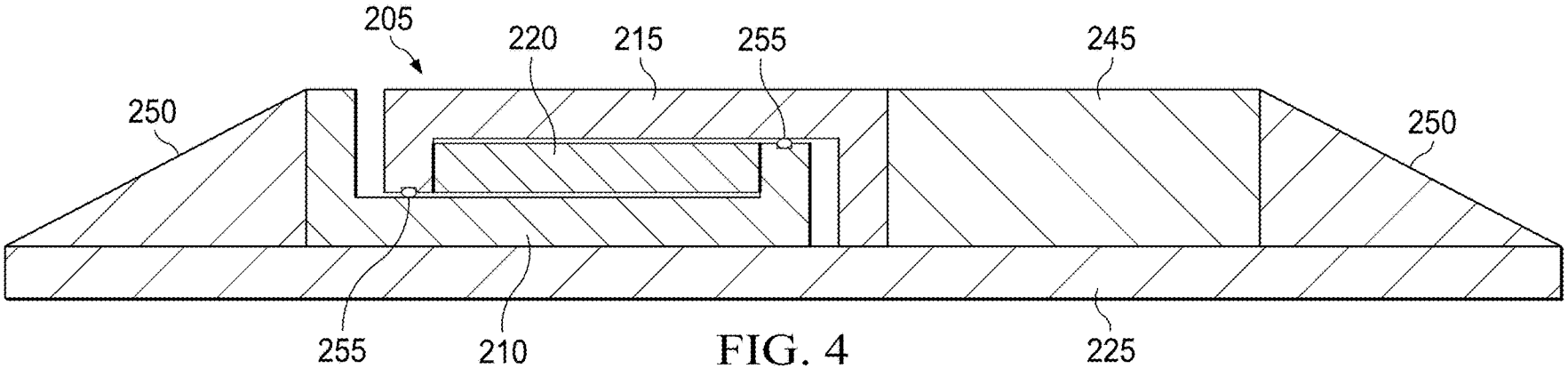
FIG. 4 is a schematic illustrating the thermal compensator of FIG. 3 as disposed on a mandrel in accordance with one or more examples described herein.
Figure 5:
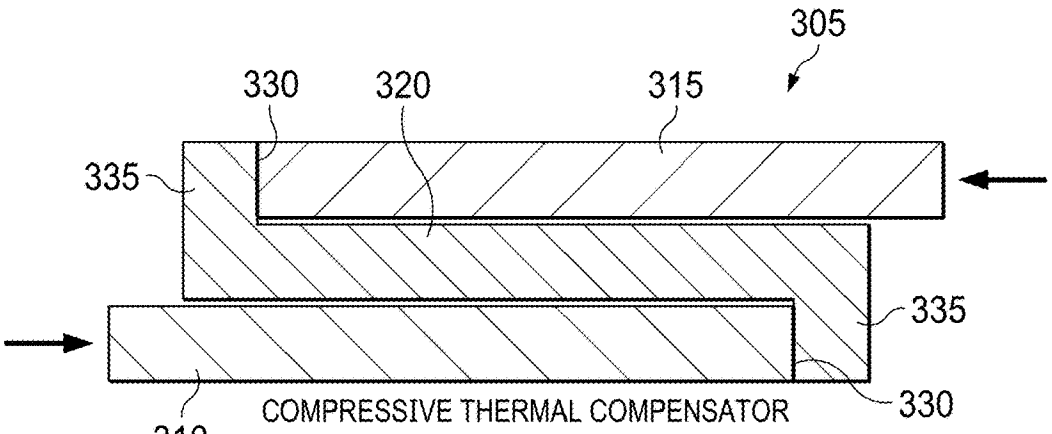
FIG. 5 is a schematic illustrating another example thermal compensator in its neutral state in accordance with one or more examples described herein.

FIG. 4 is a schematic of the thermal compensator 205 of FIG. 3 on a mandrel 225. The thermal compensator 205 is disposed between wedges 250 and is configured to be adjacent to a sealing element 245 on its right side. Two O-ring seals 255 seal the core 220 within the inner layer 210 and the outer layer 215. This arrangement allows for the optional use of a fluid core 220 as illustrated and discussed above with FIG. 3. As the temperature decreases, the higher CTE core 220 contracts more than the lower CTE inner layer 210 and the outer layer 215. As the core 220 contraction is greater than that of the contraction of the outer layer 215, the outer layer 215 is expanded against the sealing element 245 on the right of the thermal compensator 205. The inner layer 210 remains fixed on the mandrel 225. This expansion of the outer layer 215 provides the effect of a net negative CTE thermal compensator 205 that expands as the temperature cools. This expansion pressure may assist the adjacent sealing element 245 in maintaining its expanded state during the cooling fluctuation which may improve seal integrity. FIG. 5 illustrates an alternative example of a thermal compensator 305. The geometries of the core 320, the inner layer 310, and the outer layer 315 have been altered such that the core comprises the lips 335 and the inner layer 310 and outer layer 315 do not comprise lips. Connection points 330 couple the core 320 to the inner layer 310 and the outer layer 315 as described above. The thermal compensator 305 functions analogously to the other examples of the thermal compensators described herein except the load path has been altered. For example, in FIG. 1C the tension force of the core 20 pulls the core-adjacent opposing ends of the inner layer 10 and outer layer 15 towards one another (i.e., the ends of the inner layer 10 and the outer layer 15 comprising the lips 35 are pulled toward each other). In FIG. 5, the compression force of the core 320 pushes the core-adjacent opposing ends of the inner layer 310 and outer layer 315 towards one another (i.e., the ends of the inner layer 310 and the outer layer 315 adjacent to the lips 335 of the core 320 are pushed towards each other). As such, the arrangement of the thermal compensator 305 allows the core 320 to push the inner layer 310 and the outer layer 315 instead of pulling them when contraction of the core 320 occurs.

Figure 6:
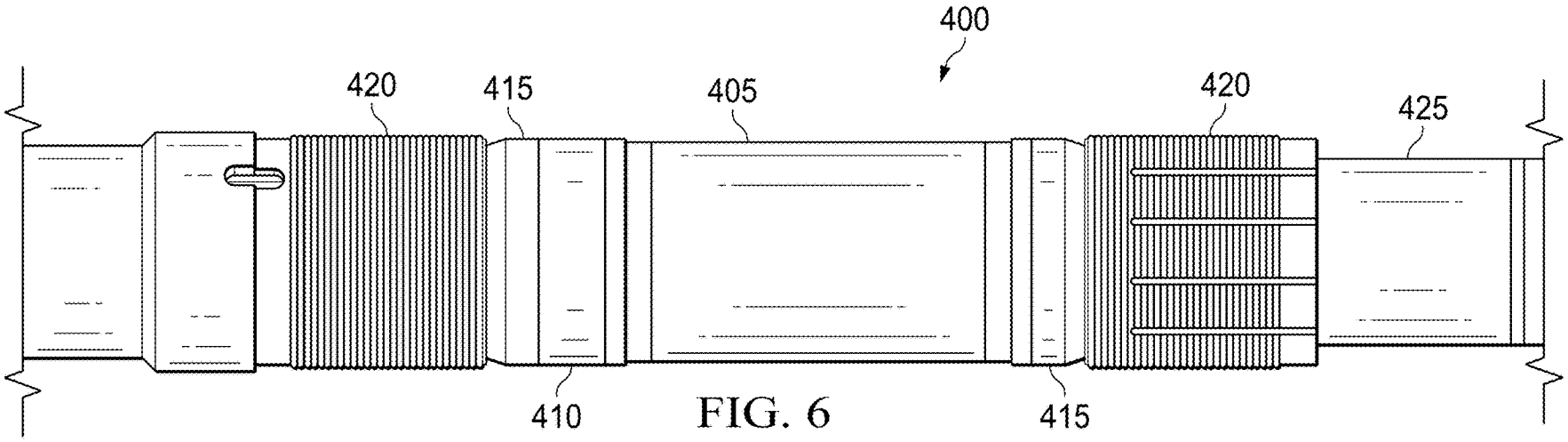
FIG. 6 is a perspective drawing illustrating another example thermal compensator as implemented with a wellbore tool and disposed adjacent to a sealing element while in its neutral state in accordance with one or more examples described herein.

FIG. 6 illustrates a thermal compensator 405 as a component of and disposed upon a wellbore tool 450. The thermal compensator 405 is placed proximate to a sealing element 410. Wedges 415 maintain the sealing element 410 and thermal compensator 405 in place during run in and use in the wellbore. Slips 420 may be disposed on the far side of each wedge 415 as illustrated. Lastly, the thermal compensator 405, sealing element 410, wedges 415, and slips 420 may all be placed on the mandrel 425. When in the desired position, the sealing element 410 may be deployed to seal an adjacent wellbore zone. The thermal compensator 405 may apply a force on the adjacent sealing element 410. During deployment of the sealing element 410, the thermal compensator 405 may be placed under compression. The force applied by the thermal compensator 405 on the sealing element 410 may range from 1,000 pounds of compressive load to 100,000 pounds of compressive load. Should temperature cycling or other temperature fluctuations occur, the thermal compensator 405 may be used to assist in maintaining seal integrity of the elastomeric element 410 by helping to provide a more consistent compressive load on the element 410.

It should be clearly understood that the example systems illustrated by FIGS. 1A-6 are merely general applications of the principles of this disclosure in practice, and a wide variety of other examples are possible. Therefore, the scope of this disclosure is not limited in any manner to the details of FIGS. 1A-6 as described herein.

As discussed above, the thermal compensator may come with or without seals between the inner, outer, and/or middle layers and the core(s). In some examples, the layers themselves will be sufficient to shield the core from contact with and potential corrosion from wellbore fluids. In other examples, O-rings or other types of sealing elements may be disposed between the inner, outer, and/or middle layers and the core(s).

The low CTE materials may include, but are not limited to zirconium tungstate, coextruded iron nickel oxide, invar, titanium, carbon steel, stainless steel, chrome alloys, nickel alloys, ceramics, tungsten, glass, or any combination of materials. The high CTE materials may include, but are not limited to, aluminum, brass, lead, polyamide-imide thermoplastics, polyetheretherketone, polyvinyl chloride, polyvinyl alcohol, acrylonitrile butadiene styrene, polytetrafluoroethylene, polyamide, polycarbonate, polyethylene, polysulfone, polyvinylidene fluoride or polyvinylidene difluoride, epoxy, rubber, paraffin wax, water, silicone oil, petroleum products, alcohol, glycerin, salt, or any combination of materials. It is to be understood that a low CTE and a high CTE are values that are relative to one another. A low CTE material may be any material sufficient for wellbore use and having a CTE lower than the selected high CTE material. Likewise, a high CTE material may be any material sufficient for wellbore use and having a CTE higher than the selected low CTE material. In some examples, the high CTE material and the low CTE material have a linear coefficient of thermal expansion that differs by at least $5\times10^{-6}$ per ° C. and preferably greater than $20\times10^{-6}$ per ° C. In a cooling environment, some negative CTE materials may expand in one direction while contracting in the other directions. These materials are not sufficient for use in the present examples despite having a negative CTE in one direction. In some examples, the low CTE materials and/or the high CTE materials may be alloys or may be alloyed with other materials.

The thermal compensator may be used in any application in which a negative TCE apparatus is desirable. The thermal compensator may be used in conjunction with compression-set packer elements of other wellbore tools and components. Additionally, the thermal compensator may be used in a variety of wells. For example, the thermal compensator may be used in geothermal wells; injection wells that inject water, steam, carbon dioxide, or hydrogen; and producing wells.

In an alternative example, any of the thermal compensators described herein may be used along a tubing string to compensate for the thermal expansion of the steel tubing. Traditionally, a travel joint may be used to accommodate the thermal expansion of the steel tubing. However, travel joints may require dynamic seals and may have trouble transmitting either load or torque. The thermal compensator may be substituted for the travel joint. A joint of tubing would be constructed as a thermal compensator and would shrink as the wellbore is heated. The thermal compensator may support tensile, compressive, and/or torque loads. Moreover, the thermal compensator may be keyed such that torque could be transmitted through the negative thermal compensator.

The exemplary thermal compensators disclosed herein may directly or indirectly affect one or more components or pieces of equipment associated with or which may come into contact with the thermal compensators such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are thermal compensators in accordance with the disclosure and the illustrated FIGS. An example thermal compensator comprises an outer layer comprising a first material, an inner layer comprising a second material, and a core disposed between the inner layer and the outer layer; wherein the core comprises a third material. The third material has a higher coefficient of thermal expansion than the first material and the second material.

Additionally or alternatively, the thermal compensator may include one or more of the following features individually or in combination. The first material and the second material may be the same type of material. The thermal compensator may further comprise a middle layer between the outer layer and the inner layer, and the middle layer may comprise a fourth material. The core may be a first core and be disposed between the inner layer and the middle layer. The thermal compensator may further comprise a second core comprising a fifth material. The second core may be disposed between the middle layer and the outer layer and the fifth material may have a higher coefficient of thermal expansion than the first material and the fourth material. The fifth material and the third material may be the same type of material. The core may comprise two terminal ends where one terminal end of the core is coupled to the inner layer and the second terminal end of the core is coupled to the outer layer. The core may be sealed between the inner layer the outer layer. The outer layer and the inner layer may each comprise a terminal end comprising a lip. The core may comprise two terminal ends with each terminal end comprising a lip and each lip is coupled to one of the inner layer or the outer layer, and the inner layer and the outer layer do not comprise a lip. The core may be a solid. The core may be a fluid. The first material and the second material may each comprise a material selected from the group consisting of zirconium tungstate, coextruded iron nickel oxide, invar, titanium, carbon steel, stainless steel, chrome alloys, nickel alloys, ceramics, tungsten, glass, and any combination thereof; and wherein the third material comprises a material selected from the group consisting of aluminum, brass, lead, polyamide-imide thermoplastics, polyetheretherketone, polyvinyl chloride, polyvinyl alcohol, acrylonitrile butadiene styrene, polytetrafluoroethylene, polyamide, polycarbonate, polyethylene, polysulfone, polyvinylidene fluoride or polyvinylidene difluoride, epoxy, rubber, paraffin wax, water, silicone oil, petroleum products, alcohol, glycerin, salt, and any combination thereof.

Provided are methods for performing a wellbore operation in a subterranean formation in accordance with the disclosure and the illustrated FIGS. An example method comprises introducing a thermal compensator into a wellbore having a temperature. The thermal compensator comprises an outer layer comprising a first material, an inner layer comprising a second material, and a core disposed between the inner layer and the outer layer; wherein the core comprises a third material. The third material has a higher coefficient of thermal expansion than the first material and the second material The core contracts when the wellbore temperature is decreasing; wherein the contraction of the core moves the outer layer such that it applies a force to a structure adjacent to the outer layer.

Additionally or alternatively, the method may include one or more of the following features individually or in combination. The structure adjacent to the outer layer may be a sealing element. The thermal compensator may be disposed on a mandrel and the structure adjacent to the outer layer is a compression-set packer. The first material and the second material may be the same type of material. The thermal compensator may further comprise a middle layer between the outer layer and the inner layer, and the middle layer may comprise a fourth material. The core may be a first core and be disposed between the inner layer and the middle layer. The thermal compensator may further comprise a second core comprising a fifth material. The second core may be disposed between the middle layer and the outer layer and the fifth material may have a higher coefficient of thermal expansion than the first material and the fourth material. The fifth material and the third material may be the same type of material. The core may comprise two terminal ends where one terminal end of the core is coupled to the inner layer and the second terminal end of the core is coupled to the outer layer. The core may be sealed between the inner layer the outer layer. The outer layer and the inner layer may each comprise a terminal end comprising a lip. The core may comprise two terminal ends with each terminal end comprising a lip and each lip is coupled to one of the inner layer or the outer layer, and the inner layer and the outer layer do not comprise a lip. The core may be a solid. The core may be a fluid. The first material and the second material may each comprise a material selected from the group consisting of zirconium tungstate, coextruded iron nickel oxide, invar, titanium, carbon steel, stainless steel, chrome alloys, nickel alloys, ceramics, tungsten, glass, and any combination thereof; and wherein the third material comprises a material selected from the group consisting of aluminum, brass, lead, polyamide-imide thermoplastics, polyetheretherketone, polyvinyl chloride, polyvinyl alcohol, acrylonitrile butadiene styrene, polytetrafluoroethylene, polyamide, polycarbonate, polyethylene, polysulfone, polyvinylidene fluoride or polyvinylidene difluoride, epoxy, rubber, paraffin wax, water, silicone oil, petroleum products, alcohol, glycerin, salt, and any combination thereof.

Provided are systems for performing a wellbore operation in a subterranean formation in accordance with the disclosure and the illustrated FIGS. An example system comprises a thermal compensator comprising an outer layer comprising a first material, an inner layer comprising a second material, a core disposed between the inner layer and the outer layer; wherein the core comprises a third material. The third material has a higher coefficient of thermal expansion than the first material and the second material and the core is configured to contract when a temperature of the wellbore is decreasing. The contraction of the core moves the outer layer such that it applies a force to a sealing element. The system further comprises a sealing element adjacent to the outer layer.

Additionally or alternatively, the system may include one or more of the following features individually or in combination. The system may further comprise a mandrel and the thermal compensator and the sealing element may be disposed on the mandrel. The sealing element may be a compression-set packer. The first material and the second material may be the same type of material. The thermal compensator may further comprise a middle layer between the outer layer and the inner layer, and the middle layer may comprise a fourth material. The core may be a first core and be disposed between the inner layer and the middle layer. The thermal compensator may further comprise a second core comprising a fifth material. The second core may be disposed between the middle layer and the outer layer and the fifth material may have a higher coefficient of thermal expansion than the first material and the fourth material. The fifth material and the third material may be the same type of material. The core may comprise two terminal ends where one terminal end of the core is coupled to the inner layer and the second terminal end of the core is coupled to the outer layer. The core may be sealed between the inner layer the outer layer. The outer layer and the inner layer may each comprise a terminal end comprising a lip. The core may comprise two terminal ends with each terminal end comprising a lip and each lip is coupled to one of the inner layer or the outer layer, and the inner layer and the outer layer do not comprise a lip. The core may be a solid. The core may be a fluid. The first material and the second material may each comprise a material selected from the group consisting of zirconium tungstate, coextruded iron nickel oxide, invar, titanium, carbon steel, stainless steel, chrome alloys, nickel alloys, ceramics, tungsten, glass, and any combination thereof; and wherein the third material comprises a material selected from the group consisting of aluminum, brass, lead, polyamide-imide thermoplastics, polyetheretherketone, polyvinyl chloride, polyvinyl alcohol, acrylonitrile butadiene styrene, polytetrafluoroethylene, polyamide, polycarbonate, polyethylene, polysulfone, polyvinylidene fluoride or polyvinylidene difluoride, epoxy, rubber, paraffin wax, water, silicone oil, petroleum products, alcohol, glycerin, salt, and any combination thereof.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A thermal compensator comprising:
an outer layer comprising a first material;
an inner layer comprising a second material;
a core disposed between the inner layer and the outer layer;
wherein the core comprises two terminal ends and each terminal end comprises a lip coupled to one of the inner layer or the outer layer, or wherein the core comprises two terminal ends and each terminal end is coupled to a lip of one of the inner layer or the outer laver;
wherein the core comprises a third material;
wherein the third material has a higher coefficient of thermal expansion than the first material and the second material.

2. The thermal compensator of claim 1; wherein the first material and the second material are the same type of material.

3. The thermal compensator of claim 1; further comprising a middle layer between the outer layer and the inner layer; wherein the middle layer comprises a fourth material; wherein the core is a first core and is disposed between the inner layer and the middle layer; wherein the thermal compensator further comprises a second core comprising a fifth material; wherein the second core is disposed between the middle layer and the outer layer; wherein the fifth material has higher coefficient of thermal expansion than the first material and the fourth material.

4. The thermal compensator of claim 3; wherein the fifth material and the third material are the same type of material.

5. The thermal compensator of claim 1; wherein one terminal end of the core is coupled to the inner layer; and wherein the second terminal end of the core is coupled to the outer layer.

6. The thermal compensator of claim 1; wherein the core is sealed between the inner layer the outer layer.

7. The thermal compensator of claim 1; wherein the core comprises two terminal ends and each terminal end is coupled to the lip of one of the inner layer or the outer laver; wherein the outer layer and the inner layer each comprise a terminal end comprising a lip.

8. The thermal compensator of claim 1; wherein the core comprises two terminal ends and each terminal end comprises the lip coupled to one of the inner layer or the outer layer; wherein each terminal end of the core comprises a lip; wherein each lip is coupled to one of the inner layer or the outer layer; and wherein the inner layer and the outer layer do not comprise a lip.

9. The thermal compensator of claim 1; wherein the core is a solid.

10. The thermal compensator of claim 1; wherein the core is a fluid.

11. The thermal compensator of claim 1; wherein the first material and the second material each comprise a material selected from the group consisting of zirconium tungstate, coextruded iron nickel oxide, FeNi36, titanium, carbon steel, stainless steel, chrome alloys, nickel alloys, ceramics, tungsten, glass, and any combination thereof; and wherein the third material comprises a material selected from the group consisting of aluminum, brass, lead, polyamide-imide thermoplastics, polyetheretherketone, polyvinyl chloride, polyvinyl alcohol, acrylonitrile butadiene styrene, polytetrafluoroethylene, polyamide, polycarbonate, polyethylene, polysulfone, polyvinylidene fluoride or polyvinylidene difluoride, epoxy, rubber, paraffin wax, water, silicone oil, petroleum products, alcohol, glycerin, salt, and any combination thereof.

12. A method for performing a wellbore operation:
introducing a thermal compensator into a wellbore having a temperature; wherein the thermal compensator comprises:
an outer layer comprising a first material;
an inner layer comprising a second material;
a core disposed between the inner layer and the outer layer; wherein the core comprises a third material;
wherein the third material has a higher coefficient of thermal expansion than the first material and the second material;
wherein the core contracts when the wellbore temperature is decreasing; wherein the contraction of the core moves the outer layer such that it applies a force to a structure adjacent to the outer layer.

13. The method of claim 12, wherein the structure adjacent to the outer layer is a sealing element.

14. The method of claim 12, wherein the thermal compensator is disposed on a mandrel and the structure adjacent to the outer layer is a compression-set packer.

15. The method of claim 12; wherein the thermal compensator further comprises a middle layer between the outer layer and the inner layer; wherein the middle layer comprises a fourth material; wherein the core is a first core and is disposed between the inner layer and the middle layer; wherein the thermal compensator further comprises a second core comprising a fifth material; wherein the second core is disposed between the middle layer and the outer layer; wherein the fifth material has higher coefficient of thermal expansion than the first material and the fourth material.

16. The method of claim 12; wherein the core comprises two terminal ends; wherein one terminal end of the core is coupled to the inner layer; and wherein the second terminal end of the core is coupled to the outer layer.

17. A system for performing a wellbore operation, the system comprising:
a thermal compensator comprising:
an outer layer comprising a first material;
an inner layer comprising a second material;
a core disposed between the inner layer and the outer layer; wherein the core comprises a third material;
wherein the third material has a higher coefficient of thermal expansion than the first material and the second material; wherein the core is configured to contract when a temperature of the wellbore is decreasing; wherein the contraction of the core moves the outer layer such that it applies a force to a sealing element; and the sealing element; wherein the sealing element is adjacent to the outer layer.

18. The system of claim 17, wherein the system further comprises a mandrel and the thermal compensator and the sealing element are disposed on the mandrel.

19. The system of claim 17, wherein the sealing element is a compression-set packer.

20. The system of claim 17, wherein the thermal compensator further comprises a middle layer between the outer layer and the inner layer; wherein the middle layer comprises a fourth material; wherein the core is a first core and is disposed between the inner layer and the middle layer; wherein the thermal compensator further comprises a second core comprising a fifth material; wherein the second core is disposed between the middle layer and the outer layer; wherein the fifth material has higher coefficient of thermal expansion than the first material and the fourth material.

* * * * *